US008257203B2

(12) United States Patent
Rasmussen

(10) Patent No.: US 8,257,203 B2
(45) Date of Patent: Sep. 4, 2012

(54) VOLLEYBALL TRAINING SYSTEM

(76) Inventor: Mike Rasmussen, Prosper, TX (US)

( * ) Notice: Subject to any disclaimer, the term of this patent is extended or adjusted under 35 U.S.C. 154(b) by 6 days.

(21) Appl. No.: 12/944,078

(22) Filed: Nov. 11, 2010

(65) Prior Publication Data

US 2011/0136596 A1 Jun. 9, 2011

Related U.S. Application Data

(60) Provisional application No. 61/260,080, filed on Nov. 11, 2009.

(51) Int. Cl.
*A63B 43/00* (2006.01)
*A63B 69/00* (2006.01)

(52) U.S. Cl. ..... 473/459; 473/576; 473/423; 473/424

(58) Field of Classification Search ..... 473/423–425, 473/430, 459, 569, 570, 575, 576
See application file for complete search history.

(56) References Cited

U.S. PATENT DOCUMENTS 3,843,126 A * 10/1974 Bandy ..... 473/576
4,127,268 A * 11/1978 Lindgren ..... 473/576
4,247,117 A * 1/1981 Reichert ..... 473/424
5,083,797 A * 1/1992 Vartija et al. ..... 473/424
5,094,462 A * 3/1992 Boyle et al. ..... 473/576
5,280,843 A * 1/1994 Vartija et al. ..... 473/576
5,358,258 A * 10/1994 Killion ..... 473/576
5,443,576 A * 8/1995 Hauter ..... 473/424
5,526,326 A * 6/1996 Fekete et al. ..... 368/10
5,586,760 A * 12/1996 Hauter ..... 473/424
5,669,837 A * 9/1997 Hauter ..... 473/576
5,772,542 A * 6/1998 Gildea et al. ..... 473/576
5,779,576 A * 7/1998 Smith et al. ..... 473/570
5,853,339 A * 12/1998 Scerbo ..... 473/576
5,976,041 A * 11/1999 Banker, Sr. ..... 473/576
6,073,086 A * 6/2000 Marinelli ..... 702/141
6,079,269 A * 6/2000 Dilz, Jr. ..... 73/488
6,152,838 A * 11/2000 Killion ..... 473/424
6,157,898 A * 12/2000 Marinelli ..... 702/141
6,270,434 B1 * 8/2001 Shaw ..... 473/553
6,352,484 B1 * 3/2002 Killion ..... 473/424
7,445,568 B1 * 11/2008 Steffensmeier ..... 473/430
8,043,173 B2 * 10/2011 Menalagha et al. ..... 473/464
2003/0230230 A1 * 12/2003 Lim et al. ..... 116/264
2006/0183570 A1 * 8/2006 Gamsaragan et al. ..... 473/424
2007/0155544 A1 * 7/2007 Killion ..... 473/424
2009/0048044 A1 * 2/2009 Oleson et al. ..... 473/570
2009/0325739 A1 * 12/2009 Gold ..... 473/570
2010/0075784 A1 * 3/2010 Maina ..... 473/424
2010/0184563 A1 * 7/2010 Molyneux et al. ..... 482/1
2010/0240476 A1 * 9/2010 Des Roches ..... 473/423
2011/0136596 A1 * 6/2011 Rasmussen ..... 473/459
2011/0183783 A1 * 7/2011 Rahim et al. ..... 473/422

* cited by examiner

*Primary Examiner* — Raleigh W. Chiu
(74) *Attorney, Agent, or Firm* — Wilson Legal Group, P.C.; John T. Wilson; Kandace D. Walter

(57) ABSTRACT

The present invention is a volleyball training system that allows a user to practice hitting a ball without the inconvenience of retrieving the ball. The ball is connected to the user's body so that once hit, the ball will not travel far distances requiring retrieval by the user. The system includes a volleyball tethered to a band that is secured to the user's body. The first end of the tethering cord is secured to the volleyball with a plug. The cord runs through the ball, secured to the second side of the ball with a plug, while the second end of the cord is secured to the band, which is secured to the user's body on either wrist. A portion of the cord runs through the diameter of the ball such that the cord is attached to opposite ends of the ball.

8 Claims, 4 Drawing Sheets

VOLLEYBALL TRAINING SYSTEM

CROSS-REFERENCE TO RELATED APPLICATIONS

This application claims the benefit of U.S. Provisional Patent Application No. 61/260,080, filed Nov. 11, 2009, and entitled "Volleyball Training System", the entire disclosure of which is incorporated herein by reference.

TECHNICAL FIELD

This invention relates to sport practice apparatuses and systems, and more particularly to volleyball training and monitoring apparatuses.

REFERENCE APPLICATIONS

| | | |
|---|---|---|
| 1 | 7,510,493 | Sports skills training apparatus |
| 2 | 7,445,568 | Volleyball training device |
| 3 | 7,285,061 | Sports skills training method and apparatus |
| 4 | 7,041,016 | Volleyball spiking training system |
| 5 | 6,171,205 | Volleyball training device |
| 8 | 5,669,834 | Volleyball blocking training device |
| 9 | 5,588,655 | Volleyball training device |
| 10 | 5,575,481 | Volleyball training aid |
| 11 | 5,460,385 | Athletic game training aid |
| 12 | 5,238,251 | Volleyball training and monitoring apparatus |
| 13 | 5,165,696 | Volleyball training harness |
| 14 | 5,060,946 | Volleyball practice device |
| 15 | 4,881,742 | Volleyball technique trainer |
| 16 | 4,372,561 | Volleyball practice apparatus |
| 17 | 4,022,471 | Volleyball training and blocking device |

BACKGROUND & SUMMARY

There are more than 46 million Americans who play volleyball. There are 800 million players worldwide who play volleyball at least once a week. Although developed in 1895, volleyball in recent years has experienced tremendous growth in popularity, both as a spectator and as a participant sport. Numerous practice devices have been proposed and implemented for developing and polishing skills such as spiking, serving, blocking, jumping, and the like. In the sport of volleyball spike plays, accurate hitting of the volley ball, and correct jumping and positioning are perhaps the most important and difficult skills to learn and perfect. It is difficult to coach and teach the skills required in volleyball since the plays involve quick striking and spiking of the volleyball often completed in a jumping position off of the floor. To be effective, the coach must be extremely vigilant and observant of the player's setting and service, and of course, where the struck ball goes and the speed at which it travels. Of great importance are an effective, service, the quality of hit, and hand and wrist orientation at ball impact. All of these observations are difficult, if not impossible to make on a consistent basis, and often required hours of practice on the court or within a separate device which is out of the financial reach of most players.

Prior to the present invention there was no integrated practice apparatus available which could effectively replicate the service of a volleyball with the feel of a real ball. Various volleyball practice apparatuses have been proposed and implemented. For example, training apparatuses have been developed to support a game ball at a selected elevation for practice purposes. A typical volleyball training apparatus includes an upright post extending from a weighted base. A lateral arm extends outward from the post to a ball support. Such apparatuses are usually bulky and not convenient for home or travel use, nor are they capable of providing feedback to the user to indicate when a correct or an incorrect hit has been made in a remote environment without bulky equipment. Other apparatus include a net covering the volleyball further attached by a band around the waist. Such an apparatus provides for an artificial service experience and an unnatural feel of the ball upon service.

Accordingly, it is a primary object of this invention to provide an improved volleyball set and service training apparatus designed so that it can be used in any location and under any circumstances with little to no effort in retrieving the volleyball, all while maintaining the feel of a real service.

The present invention may be made from the following materials; seven and a half (7.5) inch polyurethane ball; scn-551s and scn-400s cone urethane plugs two (2) per ball; five and a half (5.5) feet of one eight (⅛) cord; one (1) ten (10) inch velcro wrist strap, and a hog ring connecting the cord to the wrist strap. In this embodiment, the cord runs from one side of the ball to the second side of the ball with a length of the cord traversing the interior of the ball. The first plug is placed in the first end of the ball where the first end of the cord is secured to the first plug. The first end of the cord runs from the first plug through the interior, of the ball to the second plug. The second plug is placed in the second end of the ball, directly across from the first plug, where a portion of the cord is secured to the second plug and the remainder of the cord remains outside the ball. The second end of the cord is connected to the strapping means with a hog ring or other connection device. The length of cord running between the first and second ends of the ball is comparable to the length of the diameter of the ball. The remainder of the cord remains outside the exterior surface of the ball. These materials may be changed or substituted to include like materials, or customized in length, width and size to accommodate an individual user's physical stature such as height and weight, as applicable.

The strapping means may consist of a rubber bracelet, buckles, ties, Velcro of other like materials capable for forming a secure wrist band around the user. The tethering means may consist of a rubber cord, elastic cord, plastic, cord, rope, or other like materials capable of retraction after the user sets and serves the volleyball. The tethering means may have a length, a width, and that varies from a minimum about equal to about the width to a maximum about equal to the distance from the service point to the center line, or such other length sufficient to simulate an effective volleyball service. The tethering means strip may have a plurality of markings indicating a variety, of possible distances for volleyball service, and may serve as visual aids to the volleyball player during a serve. The wrist band strap may house a mechanism for retracting the cord automatically, and coiling the cord around the wrist band strap such that the rope returns to its initial position prior to service. The mechanism for retracting the cord would employ a spring force capable of retracting the cord upon the user manually releasing the mechanism from the wrist band strap.

It is a further an objective of the invention to provide a volleyball training and monitoring apparatus with means to indicate the distance, speed, and force of the ball as served by the individual user through a computational means and output device worn on the user's wrist. The preceding invention variant may be established by using a simple LED display or other like visual display device on the users' wrist, with the distance, speed and force of the ball being computed by a central processing unit (CPU) within the ball itself, all connected through a wire capable of transmitting data from the CPU within the ball through the tethering means to the LED display on the user's, wrist band. Alternatively, the CPU may be contained within the wrist band itself for the purposes of determining distance and/or speed though said wire for display on user's wrist band.

BRIEF DESCRIPTION OF THE DRAWINGS

For a more complete understanding, attached are drawings which show the system and method in various configurations.

FIG. 1A: The volleyball apparatus.

FIG. 1B: The elastic cord which connects the volleyball to the wrist band;

FIG. 1C: The plastic plug which tethers the elastic cord through the ball, holding the cord securely in place while in use;

FIG. 1D: The cord, securely held in place by the plastic plug;

FIG. 1E: The wrist band, which is sewn to the elastic cord, allows for the user of the "volleyball training system" to practice serving, bumping, and spiking without ever losing control of the ball;

FIG. 1F: The Velcro which keeps the wrist band securely wrapped around user's wrist;

FIG. 2A: Close up view of the volleyball apparatus;

FIG. 2B: The plastic plug which tethers the elastic cord through the ball, holding the cord securely in place while in use;

FIG. 2C: The cord, securely held in place by the plastic plug;

FIG. 2D: The elastic cord which connects the volleyball to the wrist band;

FIG. 3A: The connection point between the cord and the wristband;

FIG. 3B: The Velcro portion of the wristband which secures the band around user's wrist;

FIG. 3C: The elastic cord which connects the volleyball to the wrist band;

FIG. 4A: The wrist band which is connected to the elastic cord;

FIG. 4B: The user's arm, to which the wrist band is connected;

FIG. 4C: The elastic cord which connects the volleyball to the wrist band;

FIG. 4D: The volleyball apparatus.

Figure 1:
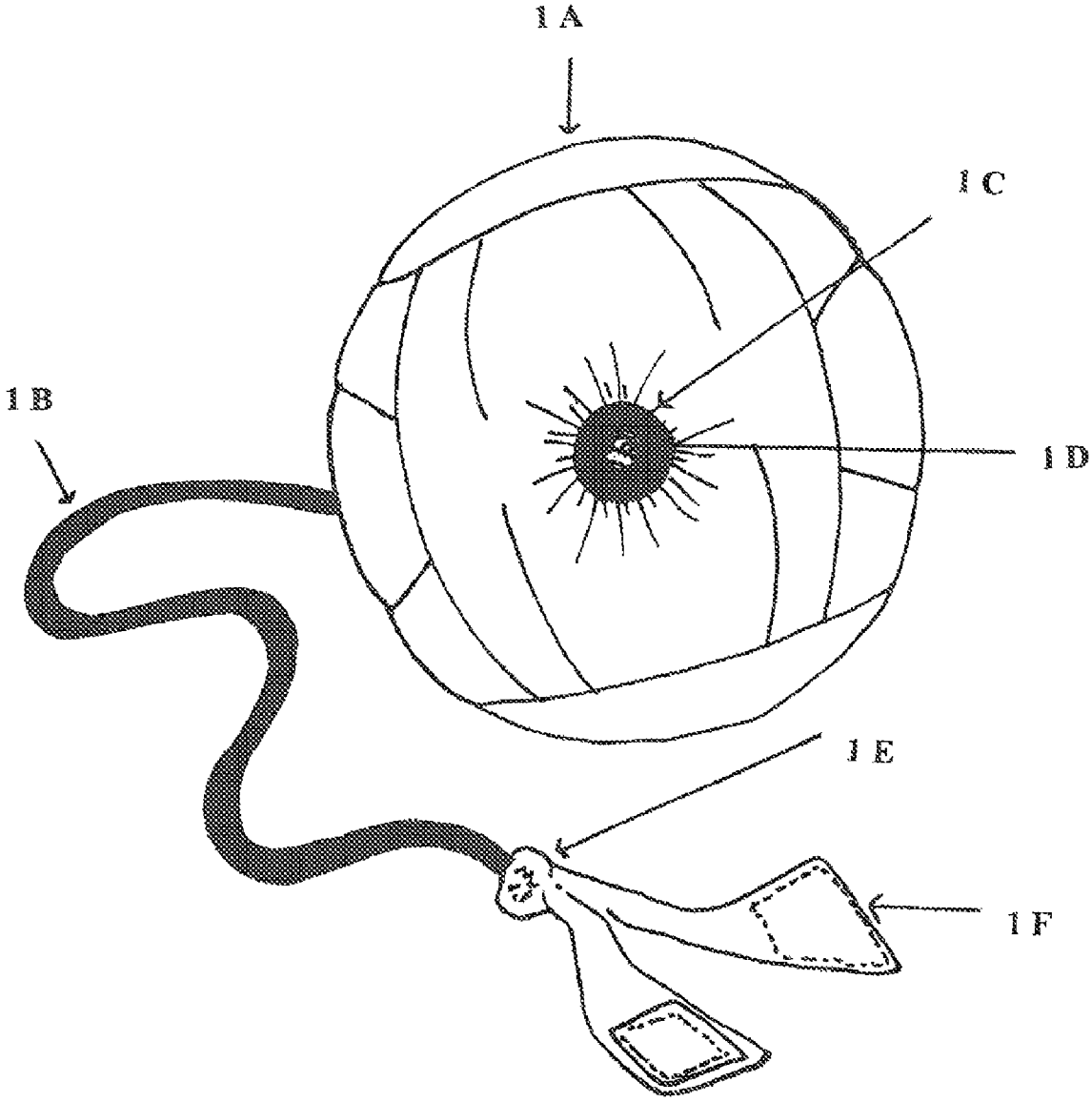
FIG. 1: Illustration of the "volleyball training system" invention (side A)
Figure 2:
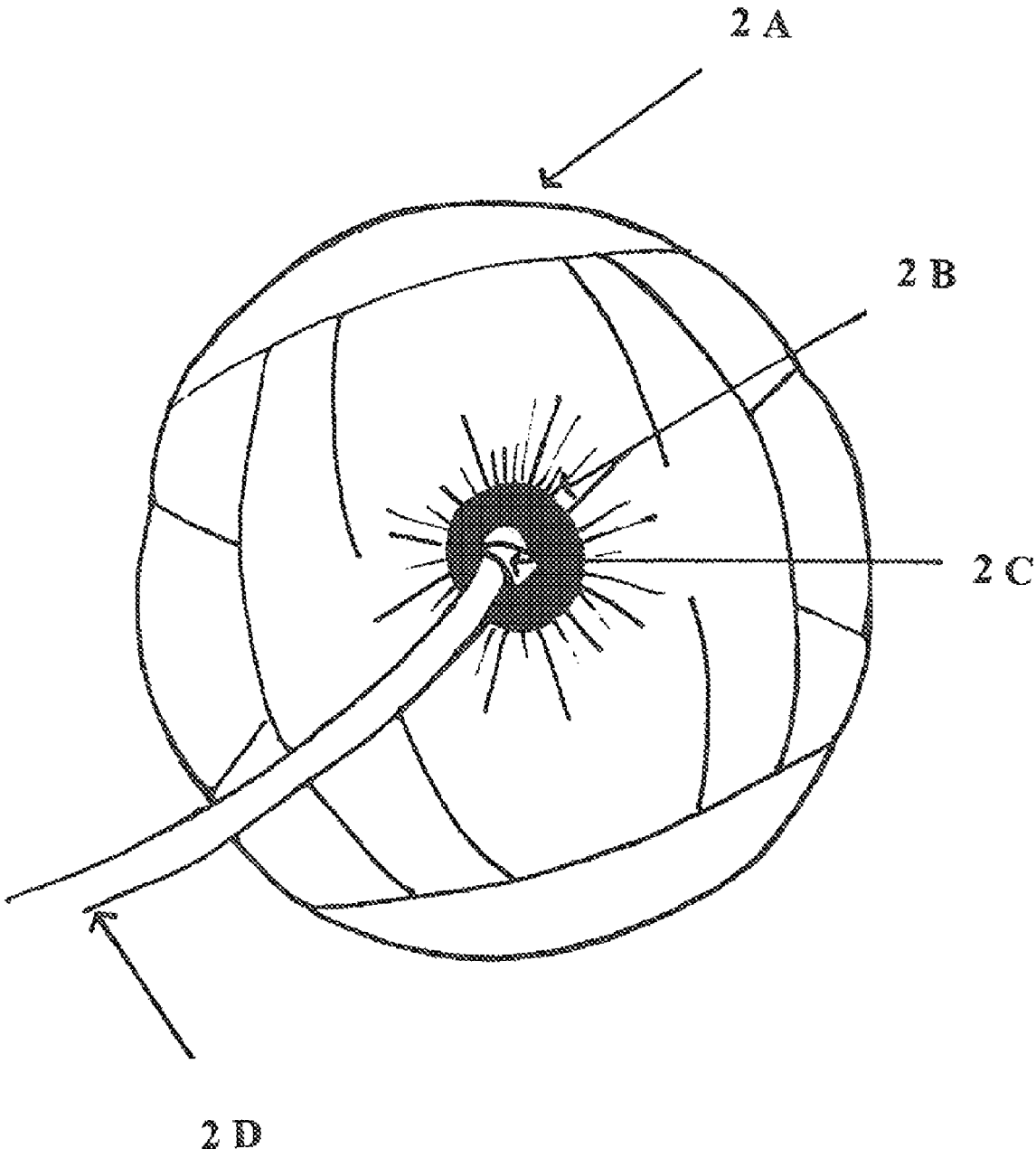
FIG. 2: Illustration of the "volleyball training system" invention (side B)
Figure 3:
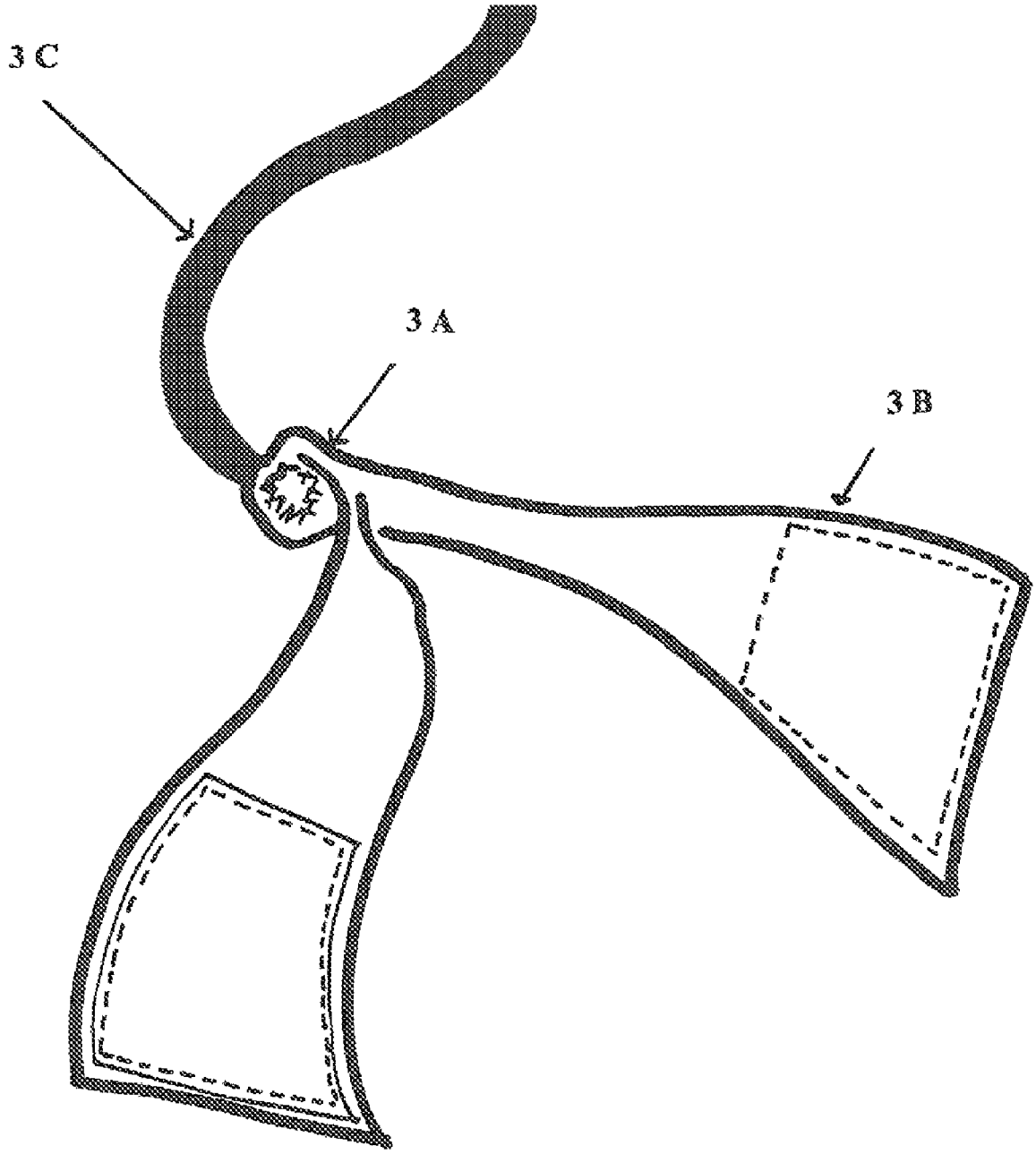
FIG. 3: Close up view of the wrist band.
Figure 4:
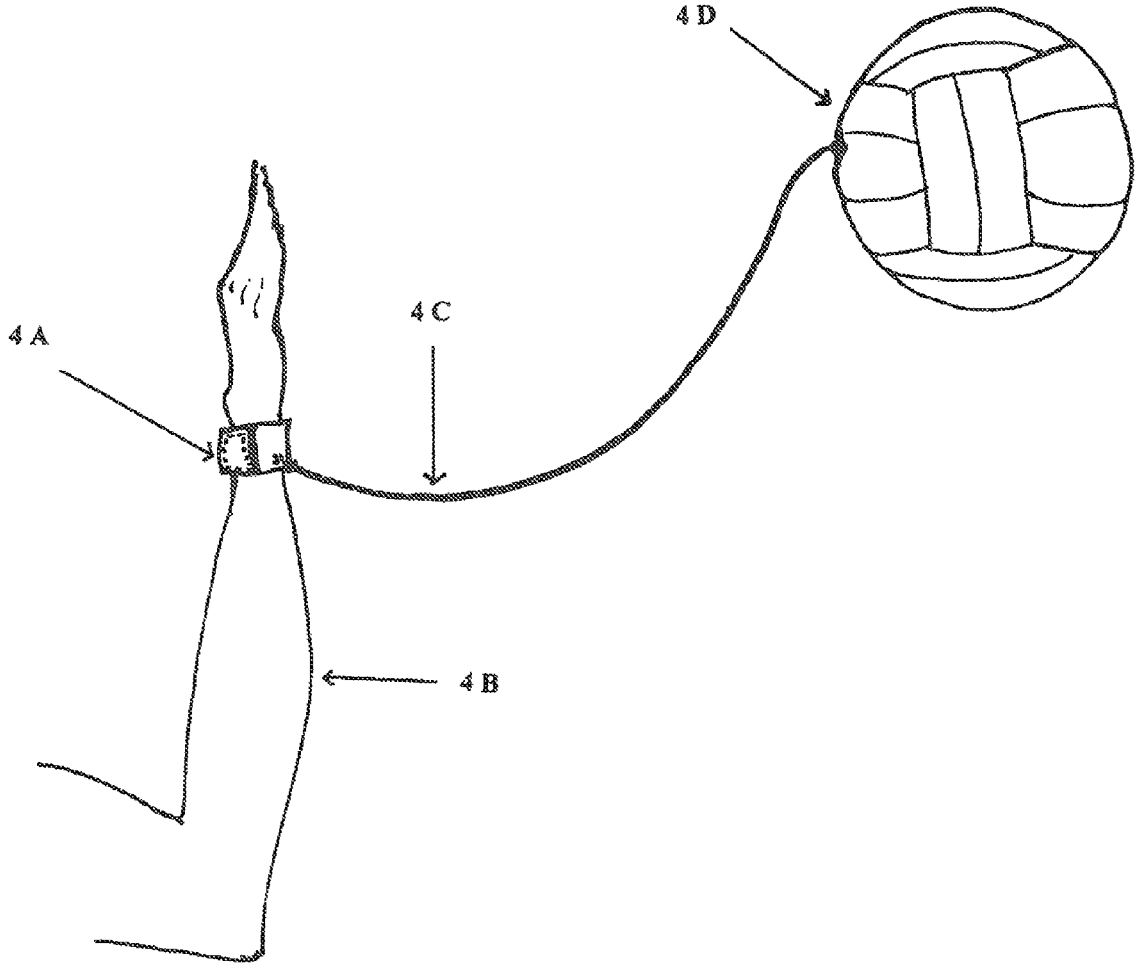
FIG. 4: Illustration of the volleyball training system in use by user.

The invention claimed is:

1. A sports training device comprising a volleyball with a first plug on the first end of said volleyball and a second plug on the second end of said volleyball wherein said first plug is positioned directly across from said second plug, a tethering means with a first end and second end, said tethering means securely connected to said volleyball on said first end of said tethering means at said first plug, said tethering means traversing the interior of said volleyball such that said tethering means is attached to opposite side of said volleyball at said second plug such that the remainder of said tethering means is positioned outside the exterior of said volleyball, a strapping means securely connected to said second end of said tethering means wherein the strapping means securely fastens around a human wrist.

2. The sports training device of claim 1, wherein the tethering means is a rope.

3. The sports training device of claim 2, wherein said rope is made of a material selected from the group consisting of cord, rubber, plastic, and elastic.

4. The sports training device of claim 1, wherein the said strapping means is selected from the group consisting of rubber bracelet, elastic band, wrist buckles, wrist ties and velcro band.

5. A sports training device as defined in claim 1; and further comprising means for computing the speed of said volleyball during service, such results of said speed computation displayed on said strapping means through a display device attached to said strapping means.

6. A sports training device as defined in claim 1; and further comprising means for computing the length the volleyball would have traveled as if untethered, such results of said length computation displayed on said strapping means through a display device attached to said strapping means.

7. A sports training device as defined in claim 1; and further comprising means for computing the force imputed on said volleyball during service, such results of said imputed force computation displayed on said strapping means through a display device attached to said strapping means.

8. The sports training device of claim 1 wherein said volleyball is selected from the group consisting of foam, rubber, polyurethane, and vinyl.

* * * * *